US006604611B2

(12) United States Patent
Liu et al.

(10) Patent No.: US 6,604,611 B2
(45) Date of Patent: Aug. 12, 2003

(54) CONDITION-BASED, AUTO-THRESHOLDED ELEVATOR MAINTENANCE

(75) Inventors: Jun Liu, Berwyn, PA (US); Juan A. Lence-Barriero, Santiago de Compostela (ES); Chouhwan Moon, Glastonbury, CT (US); Harry Z. Huang, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/036,223

(22) Filed: Dec. 28, 2001

(65) Prior Publication Data

US 2003/0121730 A1 Jul. 3, 2003

(51) Int. Cl.[7] ..... B66B 3/00
(52) U.S. Cl. ..... 187/391; 187/247; 187/316
(58) Field of Search ..... 187/247, 248, 187/391, 393, 316, 317, 284, 291; 49/26, 28; 702/183–188

(56) References Cited

U.S. PATENT DOCUMENTS 3,973,648 A * 8/1976 Hummert et al. ..... 187/393
4,418,795 A 12/1983 Trosky et al.
4,512,442 A * 4/1985 Moore et al. ..... 187/393
4,750,591 A * 6/1988 Coste et al. ..... 187/391
4,898,263 A * 2/1990 Manske et al. ..... 187/247
4,930,604 A * 6/1990 Schienda et al. ..... 187/393
5,557,546 A * 9/1996 Fukai et al. ..... 702/185
6,330,936 B1 * 12/2001 Lence Barreiro et al. ... 187/393
6,439,350 B1 * 8/2002 Lence Barreiro et al. ... 187/391
6,484,125 B1 * 11/2002 Huang et al. ..... 702/183
2003/0000777 A1 * 1/2003 Lence Barreiro et al. ... 187/391

FOREIGN PATENT DOCUMENTS

WO WO 02/36476 A1 5/2002

* cited by examiner

*Primary Examiner*—Jonathan Salata

(57) ABSTRACT

Variable thresholds (662, 663) are generated in response to an average defect rate (669, 690) generated under certain conditions (683–687, 696–698), excesses of which can set an internal flag (670). If an information request (720) or service personnel visit to the elevator site (721) occur, the internal flag, or the upward adjustment of the average defect rate (691) can generate a maintenance flag (773) which ultimately results in a maintenance recommendation message related to the particular parameter having a notable defect.

23 Claims, 8 Drawing Sheets i
i+1
$O_{CTR} > 1/2\ o_i$ i
i+1
$O_{CTR} < 1/2\ o_i$ i
INFO REQ.

i
RESUME i+1
VISIT i
NEW ALG. PERIOD i+1
INFO REQ.

i−2
i−1
i
i+1
VISIT
FIRST PASS i−2
i−1
i
i+1
VISIT
SECOND PASS i−2
i−1
i
NEW ALG. PERIOD i+1

CONDITION-BASED, AUTO-THRESHOLDED ELEVATOR MAINTENANCE

TECHNICAL FIELD

This invention relates to generating maintenance recommendation messages in response to the rate of occurrence of notable events or conditions exceeding variable thresholds which are continuously adjusted in dependence upon said rate of occurrence.

BACKGROUND ART

Elevator maintenance is currently scheduled in response to the amount of time which has elapsed since the previous maintenance, or in response to the number of operations of an elevator, subsystem or component since the previous maintenance. This results in performing unnecessary maintenance on some equipment, and performing less than adequate maintenance on other equipment.

A recent innovation is disclosed in commonly owned copending U.S. patent applications Ser. No. 09/898,853, filed Jul. 3, 2001, now U.S. Pat. No. 6.516.923, and Ser. No. 09/899,007, filed on Jul. 3, 2001. In said prior pair of applications, a large number of elevator door events and conditions are monitored, and maintenance messages are provided to assist service personnel in response to occurrence of certain notable events. In the systems disclosed in said applications, in some instances, the occurrence of a notable event only a single time (such as an average value being too high) will cause maintenance messages to be generated; in other cases (such as a door opened or closed position being wrong), the maintenance message will be generated only after a threshold number of occurrences of that notable event, but that threshold number is fixed. While those systems provide condition-related maintenance messages, rather than being based upon elapsed time or number of operations alone, the need for service is still not tailored to the particular elevator. As an example, it may happen that in one elevator, that certain notable events or conditions may occur rather frequently, even though there is nothing wrong with any components of the elevator, and there is no service which, when performed, will alter the situation; but it may happen in another elevator that the same notable events or conditions occurring the same or fewer number of times may be indicative of a faulty component for which service is required: the foregoing systems do not separate therebetween.

DISCLOSURE OF INVENTION

Objects of the invention include: reducing unnecessary elevator maintenance; improving elevator maintenance to the level which is required; providing the proper level of maintenance to elevators; elevator maintenance which can take into account the variation in condition of parameters between elevators, which are altered by deviations in the environment and by deviation in the maintenance provided thereto; provision of maintenance recommendations which permit service personnel to concentrate on elevator conditions that are likely to disrupt normal elevator operations; improved elevator service quality; and reduced elevator service cost.

This invention is predicated on the perception that the occurrence of notable events or notable values of parameters, herein referred to as "defects", may or may not be indicative of the need to replace or to provide service to a component or subsystem of the elevator. This invention is further predicated on the discernment of the fact that deterioration of elevator components, subsystems, or adjustments are best indicated by the trends in notable elevator events or conditions.

According to the present invention, the occurrence of events or conditions which are deemed notable with respect to the need for elevator maintenance, herein referred to as "defects", are utilized to generate operation-averaged rate of occurrence of such defects, which in turn are utilized to generate thresholds for each such defect, the thresholds in turn being utilized to signal the need for maintenance recommendation messages. According to the invention, for each possible defect being monitored, there is a finite but variable algorithm period, which may for instance be on the order of when several defects have occurred, when the number of operations exceed 2,000 operations, or after the elapse of 14 days. At the end of each algorithm period, the rate of defects (number of defects ratioed to the total number of operations of the related element or subsystem) is calculated; then a new threshold deviation is calculated based upon the established average defect rate and the number of operations during the algorithm period; then upper and lower thresholds are calculated based on the recently calculated threshold deviation and the established average defect rate.

An internal flag is generated if the new defect rate exceeds a maximum upper threshold, or if the new defect rate and the next prior defect rate exceed their respective upper thresholds. The average defect rate is updated if three rates in a row either exceed or are less than corresponding thresholds; upward adjustments of the average defect rate being limited by number of operations and time since a maintenance flag was generated during a visit of service personnel.

The invention comes into play when there is either a request for information (such as from a central elevator monitoring facility) or a visit by service personnel. In either such case, a maintenance recommendation message will be indicated for any parameter for which there was an upward adjustment of the average rate of defects without a subsequent downward adjustment thereof, or if an internal flag had been generated for that parameter since the last visit of service personnel, and no downward adjustment of the average defect rate had occurred since then.

The particular maintenance recommendation message depends on the parameter which causes it, and other related factors, examples of said messages being set forth in the prior pair of applications.

The maintenance recommendation messages of the invention may be indicated only when requested by either a remote maintenance facility issuing a request for information, or by service personnel indicating that a maintenance visit is ongoing. On the other hand, the invention may be used to generate alerts and alarms in a fashion similar to that known to the prior art, or used otherwise.

The conditions under which maintenance recommendation messages are given differ significantly from the prior art. First, these messages are condition-dependent, being dependent upon the actual parameters of the elevator indicating notable events or conditions, called defects herein. Furthermore, not every notable event or condition is acted upon, the ones which are generated in accordance with the present invention are acted upon only when the rate of occurrence of defects exceeds variable, automatically updated thresholds for that particular parameter in that particular elevator, based upon recent operation of that elevator. Thus, only circumstances indicative of a degradation of elevator performance will result in maintenance recommendation messages being indicated, thereby limiting maintenance to that which is truly necessary in that particular elevator at that particular time.

Other objects, features and advantages of the present invention will become more apparent in the light of the following detailed description of exemplary embodiments thereof, as illustrated in the accompanying drawing.

BRIEF DESCRIPTION OF THE DRAWINGS

The following figures herein are high level logic flow diagrams of functions of the invention as follows.

MODE(S) FOR CARRYING OUT THE INVENTION

Figure 10:
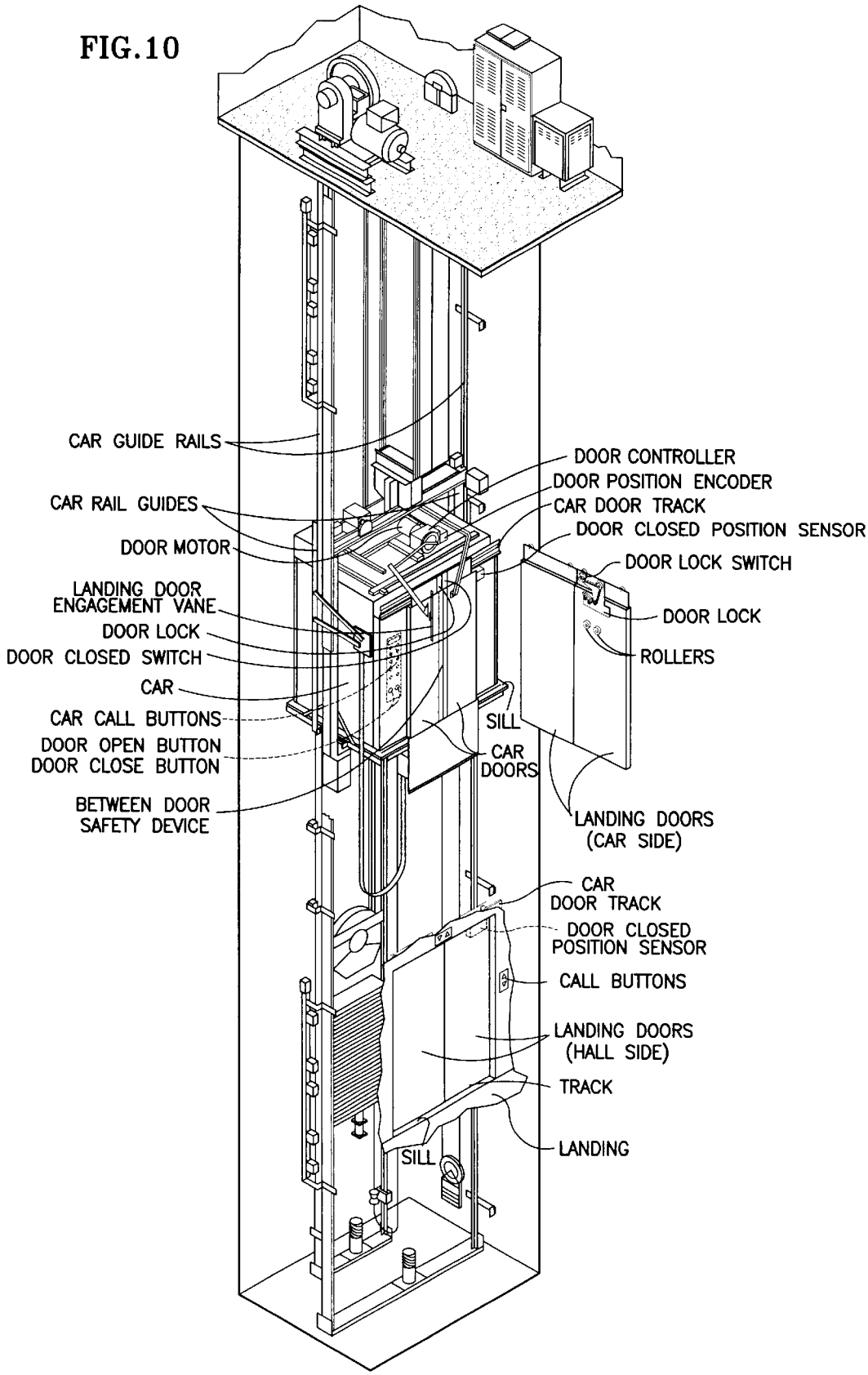
FIG. 10 is a perspective view, partially broken away, of a conventional elevator system with which the present invention may be practiced.

In FIG. 10, a conventional elevator system having a plurality of landings, only one of which is shown, includes car guide rails between which the car is juxtaposed by car rail guides. The car has doors operated by a door controller on car door tracks above a sill. The door has a door lock, a door close switch and a door close position sensor. The car door has a landing door engagement vane and the landing doors have rollers so that the car door can open and close the landing doors. In the car, there are car call buttons and door open and door close buttons. Between the car doors, there is a between door safety device.

The landing doors have a door lock switch, a door close position sensor, and are guided by car door tracks above a sill. At each landing, there are landing call buttons which have lights, as is known. Various parameters of the elevator system of FIG. 10 may be monitored by means of the invention.

It is contemplated that the present invention will be utilized working with defects of the sort described in the prior pair of applications. The invention typically will be used in a system which monitors some number of parameters, such as, for example, between 50 and 60 parameters as appear in the prior pair of applications. In the embodiment herein, for each parameter, there is a complete set of defect rate processing software that operates only with respect to that individual parameter. The software described in the figures herein is therefore the software required for a single parameter, which will be multiplied as many times as necessary so as to provide a set of similar software for each of the parameters being monitored. The invention, however, may be utilized in-a system in which only one set of software is provided, and each parameter is treated in turn by the set of software, followed by the next parameter in turn being treated by the same software. The implementation of multi-parameter software is well within the skill of the art in the light of the figures herein and the teachings hereinafter.

Herein, a defect is a notable event, which may result from an operation being too fast or too slow or lasting too long, or a parameter being too irregular, a position being wrong, and the like. A wide variety of examples are set forth in the prior pair of applications. In this embodiment, the number of operations may be the number of times that a door opens or closes, or the number of times that a door-related button switch is pressed, or the number of runs of the elevator car, and so forth, related to the defect being monitored.

For door operations, the complete opening and closing of the door is considered one operation; door operations correspond to a large number of parameters related to the elevator car door and landing doors. For landing doors, each parameter is maintained separately for each of the landing doors. For door open and close buttons, car call and landing call buttons, each stroke of a button is an operation of that button.

Factors referred to hereinafter are initialized as follows:

$k=0$ $d_{CTR}=0$ $o_{CTR}=0$ $O_{IF}ACUM=0$ $O_{UA}ACUM=0$ $O_{MFV}$ ACUM=20,001

$T_{AP}=0$ $T_{MFV}=0$

LEARNING FLG=SET

INT FLG=RESET

UAR FLG=RESET

INFO FLG=RESET

VISIT FLG=RESET

VISITED FLG=RESET

Figure 1:
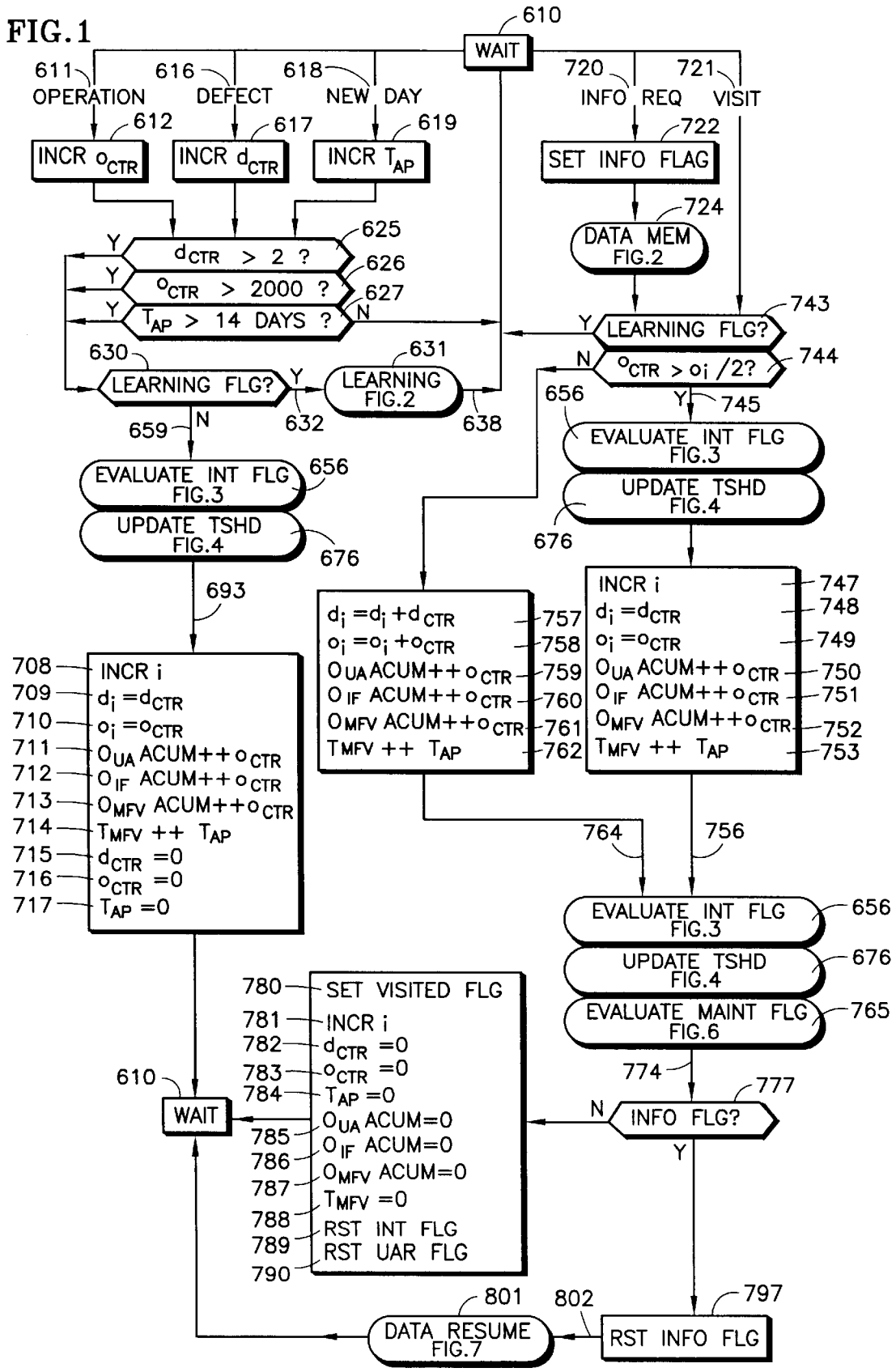
FIG. 1 main flow.

The events described hereinafter in FIG. 1 are only effective when the routine is in the WAIT state 610. In FIG. 1, each time an operation corresponding to this parameter occurs, it will cause an operation event 611 and be incremented into an operation counter, $o_{CTR}$, by a step 612. Each time a defect in this parameter occurs (a defect being a notable event or condition), it will cause a defect event 616 and be incremented by a step 617 into a defect counter, $d_{CTR}$ for this particular parameter. At the start of each day, a new day event 618 reaches a step 619 to increment an algorithm period timer, $T_{AP}$. A first test 625 determines if the number of defects, d, of the parameter under consideration exceeds two. Since the defect count is initialized at zero, test 625 will initially be negative, reaching a test 626 to determine if the number of related operations exceeds 2,000. Initially, test 626 is negative, so a test 627 determines if 14 days have elapsed since the learning process began, as indicated by the algorithm period timer, $T_{AP}$, which is incremented once each day by step 619. Initially, it will not, so a negative result of test 627 returns to the wait state 610, where it will remain until the next event 611, 616, 618 occurs in FIG. 1, after which the process is repeated. The process passing through steps and tests 625–627 will repeat following any event until eventually, either the number of defects or operations, or the lapse of time, will cause an affirmative result of one of the tests 625–627. An affirmative result of one of these tests denotes the end of an algorithm period, following which various calculations are made. Although not preferred, if desired, the algorithm periods may be demarcated by only one of the tests 625–627, or by other sets of tests.

A test 630 is reached to determine if a learning flag is set or not. Initially, it will be set (as shown in the initialized items at the top of FIG. 2), so an affirmative result of test 630 reaches a learning subroutine 631 (FIG. 2) through a transfer point 632. A step 633 calculates the rate, r, of defect generation as the ratio of the number of defects, $d_{CTR}$, to the number of corresponding operations, $O_{CTR}$. A test 637 determines if the most recently generated rate of defects exceeds a maximum upper threshold $UT_{MAX}$; the maximum and minimum upper thresholds (referred to more fully hereinafter) are established by elevator experts, and are not changed throughout the life of the elevator utilizing this invention. If the most recent rate of defect exceeds the maximum upper threshold for that parameter, then that rate is ignored by causing the program to reach the wait state 610 through a return point 638. But if the most recently generated defect rate, r, does not exceed the maximum upper threshold, $UT_{MAX}$, a negative result of test 637 reaches a step 639 to increment a learning counter, k, which was initialized at zero so it points to the first one of K learning steps, which is generally some number between three and six, and may or may not differ from one parameter to another, as desired. Then a step 640 stores the current number of defects as the number of defects for the learning step k, and a step 641 stores the current number of operations as the number of operations for the current learning step. A test 644 determines if the learning steps equal the total number of required learning steps, K. If not, the process restores the $T_{ap}$, d and o counters to zero in steps 645–647, reverts to the main program in FIG. 1 through the return point 638, and then reaches the wait state 610, and will repeat once more. As used herein, "RETURN" signifies returning to the point in FIG. 1 from which the transfer was made.

Figure 2:
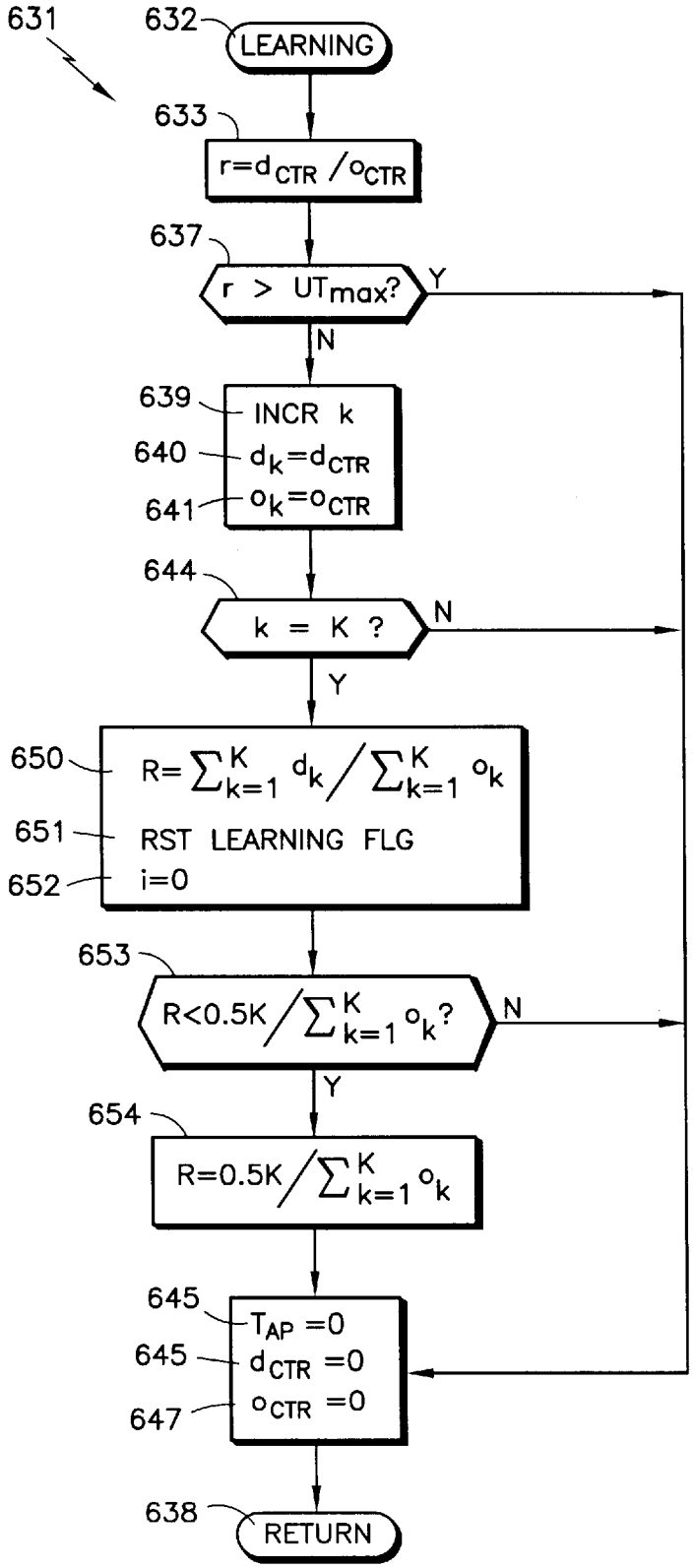
FIG. 2 learning.

The process of FIG. 2 continues, responding to events in FIG. 1, until all the learning steps, K, have been fulfilled. Then an average defect rate, R, is generated in a step 650 as the summation, for all of the K learning steps, of the stored value of defect rate, $d_k$, divided by the summation, for all of the K learning steps, of the stored value of the number of operations, $o_k$. A step 651 resets the learning flag, which signals the end of the learning subroutine 631, and a step 652 resets the algorithm period designator, i (described hereinafter) to zero. Then a test 653 determines if the newly calculated average defect rate, R, for that parameter, is less than some minimal value, such as one-half the reciprocal of the average number of operations during the K learning steps; if it is, then it is set to that value in a step 654; otherwise step 654 is bypassed. Then steps 645–647 restore the counters to zero, and the program returns to the main routine of FIG. 1 through transfer point 638, and thence to the wait state 610. Learning (for this parameter) is never again performed during the life of the elevator, unless it is following a complete elevator overhaul.

When learning is complete, any of the events 611, 616, 618 (FIG. 1) will increment the corresponding counters and accumulators and reach the series of tests 625–627 to determine if the end of an algorithm period has been reached, in the fashion described hereinbefore. If not, the program reaches the wait state 610 to await the next event 611, 616, 618.

In all of the processing that follows, the subscript i denotes successive algorithm periods. In FIGS. 8A–8H the plain vertical lines demarcate algorithm periods; the vertical arrows indicate information requests or visits. For reasons described hereinafter, the data collected in one algorithm period is processed in the next algorithm period along with the results of processing in preceding algorithm periods, i−1 and i−2. The current processing period is i.

Eventually, one of the tests 625–627 will be affirmative reaching the test 630, which is negative throughout the remaining life of the elevator with which the present invention is related. This reaches a subroutine 656, FIG. 3, through a transfer point 657, which evaluates whether or not an internal flag, indicative of a notable event, should be generated, by means of a series of algorithmic steps that are performed at the end of each corresponding algorithm period. A test 658 checks a visited flag, described hereinafter; generally, it will not be set, thereby reaching a test 659 to determine if i is zero, which it will be only in the first pass through the algorithm. If i>0, a step 660 generates a rate of defect for period i, $r_i$, as equal to the number of defects, di, subdivided by the number of operations, $o_i$. Then a step 661 generates a deviation, $\sigma_i$, as the square root of: (a) the product of (1) the current average rate and (2) one minus the current average rate, (b) divided by the number of operations, $o_i$.

Then a step 662 generates an upper threshold for this period, $UT_i$, as the maximum of either (1) a fixed, minimum value of the upper threshold, $UT_{MIN}$, or (2) the average defect rate, R, plus 2.33 times the current deviation, $\sigma_i$. The value 2.33 is the known constant for a deviation for which there is a 1% chance that the value of the sample is out of the region of interest. Utilizing the maximum of step 662 ensures that the upper threshold does not go below some minimum amount determined by experts to be the least possible value for an upper threshold of the particular parameter. However, the invention may be used without considering any $UT_{MIN}$. A step 663 sets the lower threshold, $LT_i$, equal to the average defect rate minus 2.33 times the current deviation.

Tests now determine whether or not to set an internal flag, which may be used under certain circumstances to generate a maintenance recommendation request, as is described hereinafter. A test 666 determines if i is greater than one; this is required for these tests, which involve information from algorithm period i−1. If not, the tests will await the next algorithm period, reverting to FIG. 1 through a return point 667, which leads in turn to an update threshold subroutine. But if i is greater than 1, a test 669 determines if the current defect rate exceeds the maximum upper threshold; if so, a step 670 sets the internal flag. Then, the internal flag operations accumulator, $o_{IF}$ACUM, is reset to zero in a step 671. The accumulated value of operations initialized in step 671 is used in a manner related only to internal flags, as described hereinafter. On the other hand, if test 669 is negative, a test 672 determines if the current value of defect rate, $r_i$, exceeds the current upper threshold, $UT_i$. If it does, a test 673 determines if the defect rate for the next preceding algorithm period, $r_{i-1}$, exceeds the upper threshold for the previous algorithm period, $UT_{i-1}$. If both tests 672 and 673 are affirmative, then the steps 670 and 671 establish an internal flag as described hereinbefore. If the test 669 and either of the tests 672 or 673 are negative, the steps 670 and 671 are bypassed. Although it is not preferred, step 670 may set the internal flag in response to an affirmative result of test 672, without considering the prior algorithm period (without test 673). Then the program reverts to FIG. 1 through the return point 667.

Figure 4:
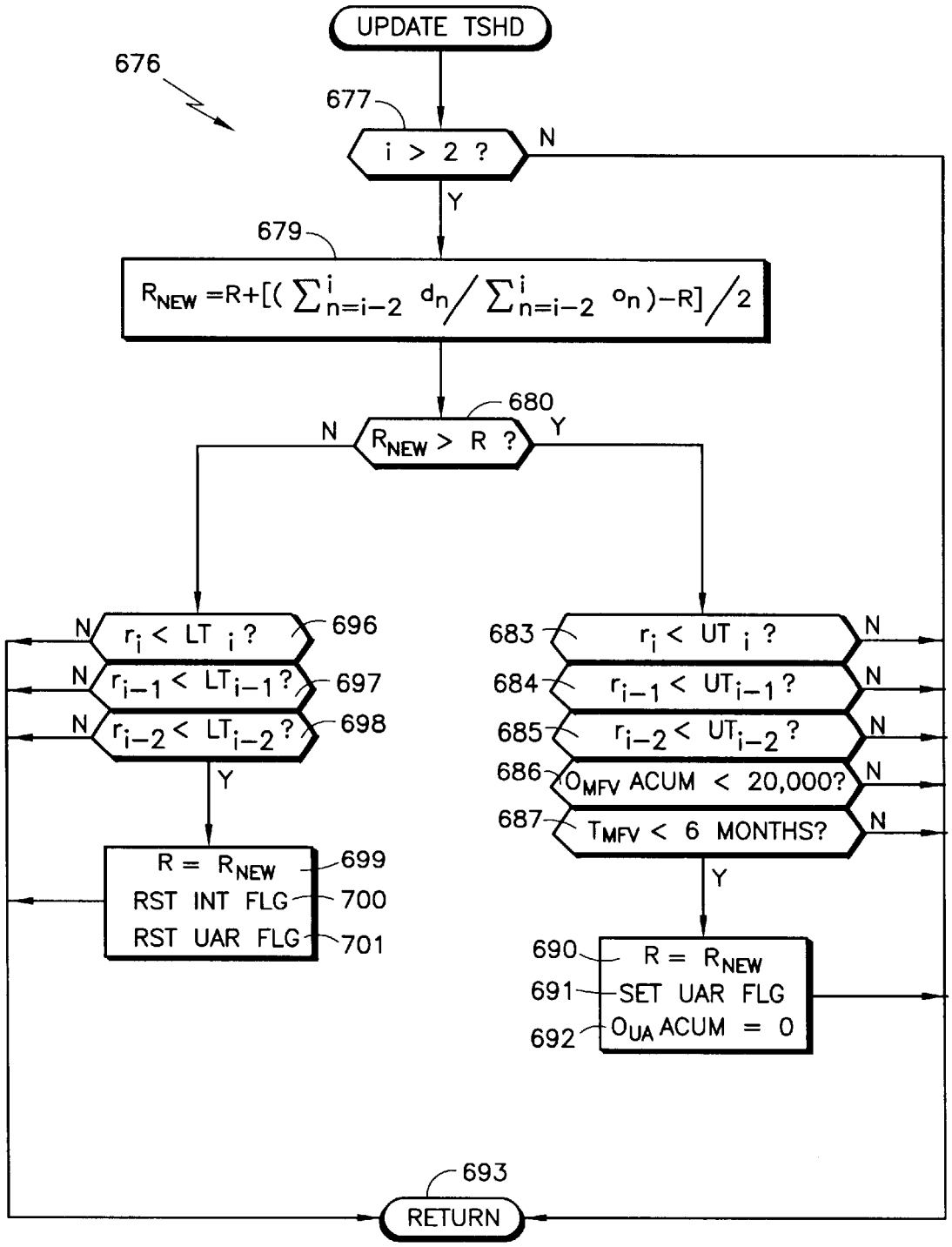
FIG. 4 update threshold.

Since the tests in FIG. 4 involve information from algorithm period i−2, a test 677 determines if i is greater than 2; if not, no update can be performed employing i−2, so the routine reverts to FIG. 1 through a return point 693. But if i >2, a first step 679 generates a new value of average defect rate, $R_{NEW}$, as (a) the existing average defect rate, R, plus (b) one-half of the difference between (1) a newly calculated arithmetical mean of the defect rate over three algorithm periods and (2) the existing average defect rate. The newly calculated mean of the defect rate is the ratio of the summations of the values of r and o of the current cycle, i, and the next preceding two cycles, i–1, i–2, as shown in step 679 of FIG. 4. As used herein, "average" does not mean the "arithmetical mean" but the quasi-integrated value derived in step 679. Once the new rate is calculated, a test 680 determines if it constitutes an upward adjustment or a downward adjustment of the average defect rate. Assume it is an upward adjustment, a series of tests 683–685 determine if the defect rate for the last three algorithm periods respectively exceed the corresponding upper thresholds for the last three periods. If so, the average defect rate may be adjusted upwardly provided it falls within an operational period which is within 20,000 operations of the last prior maintenance recommendation message (maintenance flag, described hereinafter with respect to FIG. 6) generated in response to a site visit by service personnel, as indicated by the operations accumulator, $O_{MFV}$ACUM, and within six months ($T_{MFV}$) of the last time that a maintenance recommendation message was generated in response to a visit to the elevator site by service personnel, indicated by tests 686 and 687 being affirmative. If the defect rate exceeded the corresponding upper threshold for three algorithm periods in a row (or such other number of periods as may be selected in any embodiment), within the time and operations constraint described above, affirmative results of tests 683–687 reach a step 690 which sets the average defect rate, R, equal to the newly created defect rate, $R_{NEW}$, . Then, a flag which memorizes the upward adjustment of the average defect rate, UAR, is set in a step 691. And a step 692 restores to zero an accumulator, $O_{UA}$ACUM, which keeps track of the number of operations since the last upward adjustment of the average defect rate. If any of tests 683–687 is negative, the average defect rate, R, is not adjusted upwardly. However, although it is not preferred, either or both of the tests 686 or 687 may be omitted in any embodiment of the invention, if desired. The update subroutine then reverts to the main routine of FIG. 1 through a return point 693.

On the other hand, if test 680 indicates that the newly generated average defect rate is less than the current average defect rate, a plurality of tests 696–698 determine if the defect rates in the last three algorithm periods were less than the lower respective thresholds for the corresponding periods. If so, affirmative results of all three tests 696–698 (or such other number of tests as may be selected in any embodiment) reach a step 699 to cause the average defect rate, R, to be set equal to the newly calculated defect rate, $R_{NEW}$. This is the only function of the lower thresholds. A step 700 resets the internal flag, which may have previously been set in step 670 (FIG. 3), because a downward adjustment which occurs after an internal flag will negate the creation of a maintenance flag as a result of the internal flag (the only function of the internal flag, as is described more fully with respect to FIG. 6 hereinafter). Similarly, a step 701 will reset the flag memorizing the upward adjustment of the average defect rate, UAR, so that there is not an upward adjustment which has not been followed by a downward adjustment, thereby negating the creation of a maintenance flag and related recommendation, as described with respect to FIG. 6, hereinafter. Although not preferred, steps 700 and 701 could be omitted in a particular embodiment of the invention, if desired. Then the routine reverts to FIG. 1 through the return point 693.

Figure 3:
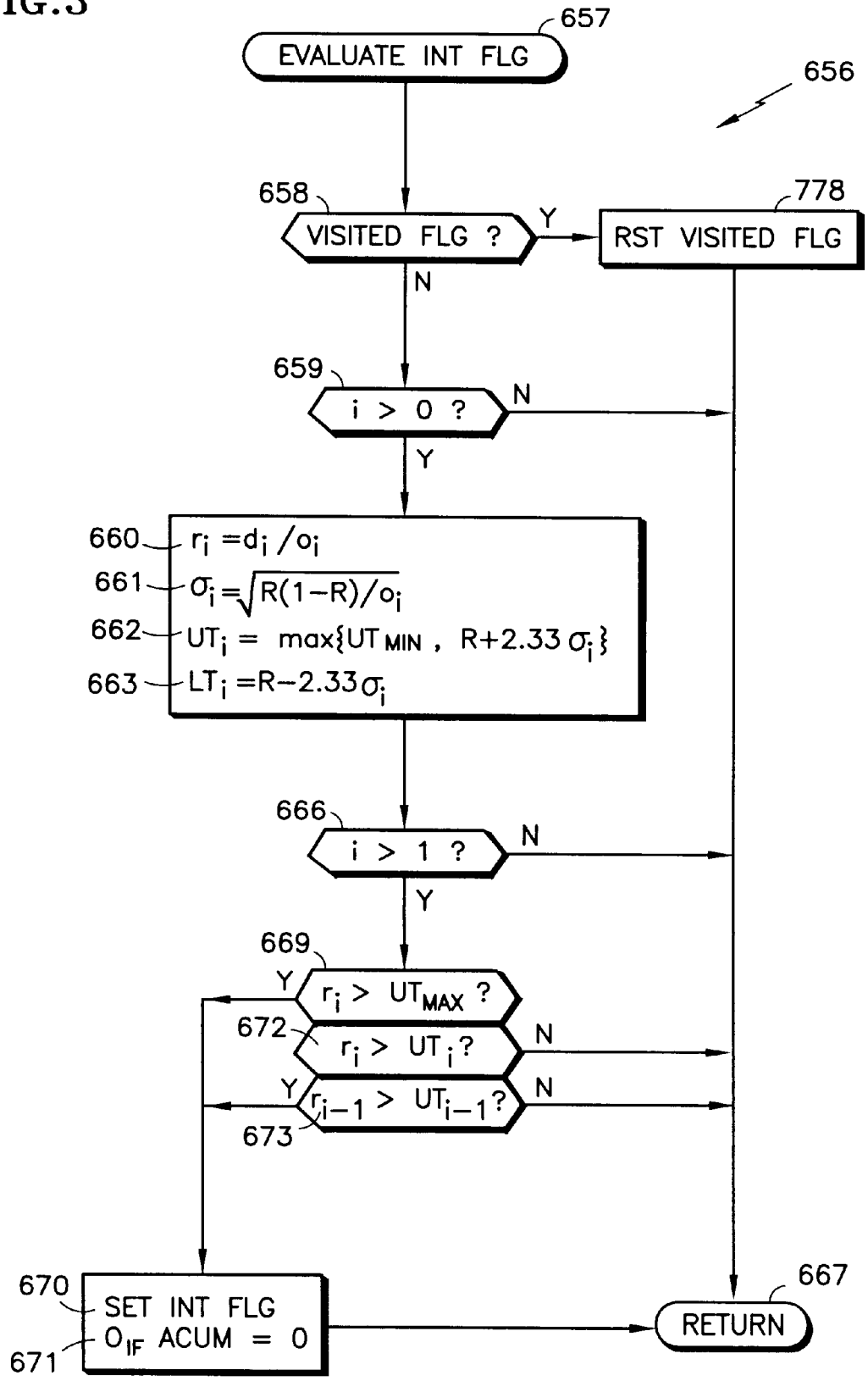
FIG. 3 evaluate internal flag.

After the internal flag and update routines of FIGS. 3 and 4, a series of housekeeping steps 708–717 (FIG. 1) close out the current algorithm period and prepare for the next period. Step 708 increments the value of i so as to point to the next algorithm period; having done that, steps 709 and 710 store the values of the d CTR and o CTR as $d_i$ and $o_i$ for the next algorithm period. Then, steps 711–713 increment the value in the accumulators for the number of operations since an upward adjustment ($O_{UA}$), since an internal flag was generated ($O_{IF}$), and since a maintenance flag is generated in response to a visit ($O_{MFV}$). The time since the maintenance flag was generated as a result of a visit ($T_{MFV}$) has added to it the extent of the present algorithm period ($T_{AP}$) in a step 714. Then steps 715–717 restore the d and o counters and the algorithm period timer to zero. The routine then reverts to the wait state 610.

The routines of FIGS. 1, 3 and 4 continue to operate, possibly resulting in upward or downward adjustment of the average defect rate, which in turn results in adjusting the thresholds (steps 661–663, FIG. 3) and possibly setting the internal flag for this parameter (step 670, FIG. 3). The upward adjustments of the thresholds or setting the internal flag may result in the setting of a maintenance flag in FIG. 6, which is the instruction to issue a maintenance recommendation message corresponding to this parameter, as described hereinafter.

Figures 8A, 8B, 8C, 8D, 8E, 8F, 8G, 8H:
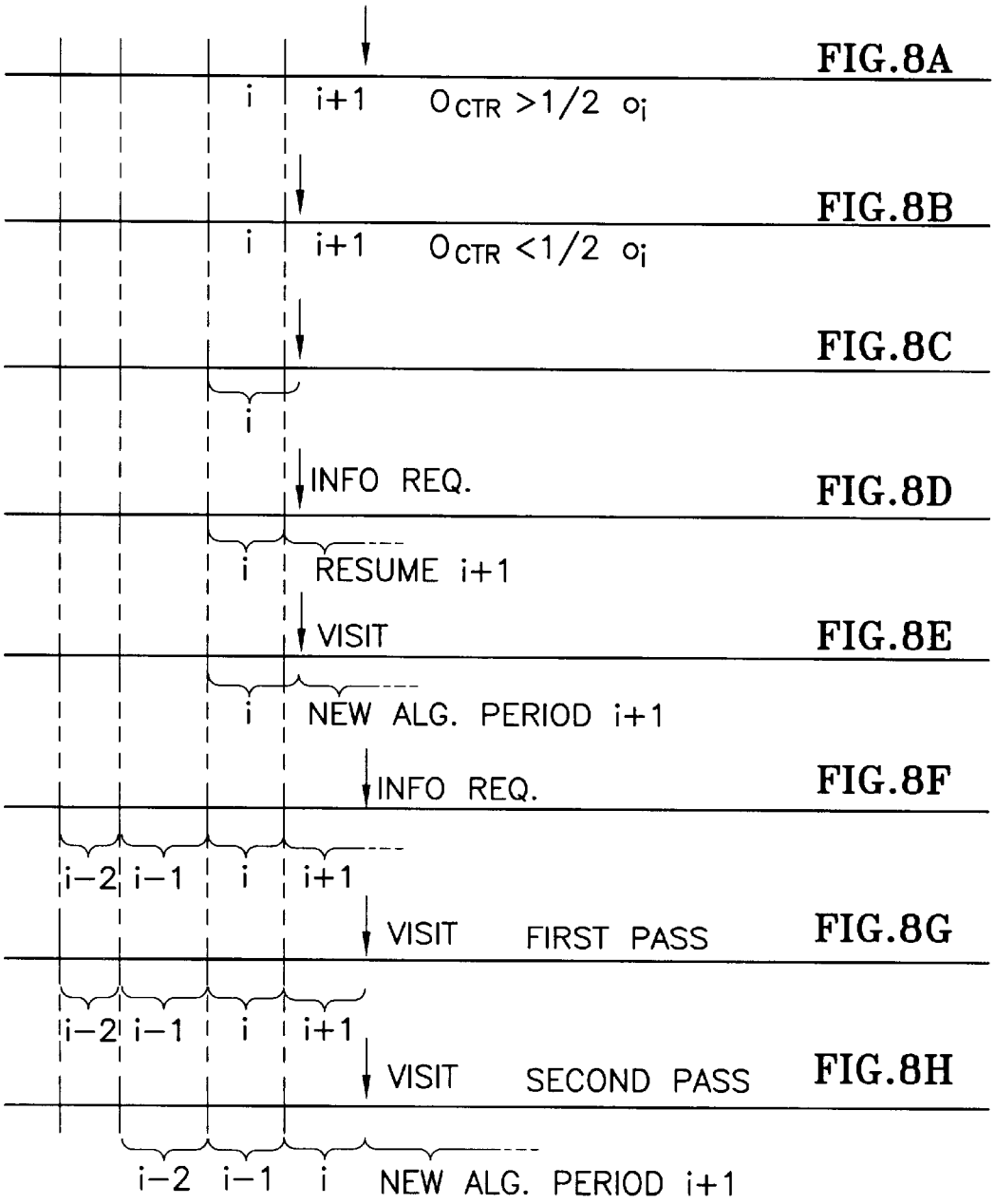
FIGS. 8A–8H are illustrations of processing on a common time base.

Referring to FIG. 1, an information request (INFO REQ) is an event initiated by off-site service personnel or equipment, for elevator condition information to be sent (such as over telephone lines) to a central monitoring station. A VISIT is the operation of a switch or the like by service personnel visiting the elevator site. These events may result in a maintenance flag, which in turn causes a maintenance recommendation message. Either an information request event or a visit event will cause performance of the steps and tests somewhat in the same fashion as does the conclusion of an algorithm period, as described hereinbefore. This is to provide updated information so as to determine whether or not a maintenance flag should be set, which in turn will cause the provision of a maintenance recommendation message, either to the remote area which initiated the information request, or to the on-site service personnel which cause the visit event. When an information request is processed, the algorithm period in which it is received is resumed (meaning that the count in the o counter and in the d counter are carried forward), regardless of whether the information request is received early in an algorithm period (FIG. 8B), requiring combining algorithm periods (FIG. 8C) or is received late enough in an algorithm period so that the algorithm period is treated as normal (FIG. 8A). The resumption occurs because of two things: the info request flag causes the o and d counts for algorithm period i+1 to be restored to the values they had before being combined with the counters of algorithm period i, and bypassing the steps 780–791, which start a new algorithm period. If an information request is received (FIG. 8A) when the value in the o counter exceeds half the value of $o_i$, the algorithm period i+1 is resumed as shown in FIG. 8D; the difference between the situation of FIG. 8A and FIG. 8B is that in FIG. 8B the data for algorithm period i must be restored whereas in the situation of FIG. 8A, no restoration is required. In the case of a visit, a new algorithm period is started at the end of processing for that visit (FIG. 8E). In the case of either an information request or a visit, if the data of two periods are combined (FIG. 8C) then only one iteration of processing is required (FIGS. 8C and 8E). On the other hand, if the values in the algorithm period within which the information request or visit is received are sufficiently great (FIG. 8A) so that no combination occurs, two iterations of processing are required (FIGS. 8G and 8H), the firs to process algorithm period i and the second to process algorithm period i+1 (FIG. 8G, which becomes period i in FIG. 8H).

The occurrence of an information request or a visit results in a corresponding event 720, 721, respectively. The info request event sets a corresponding flag in a related step 722. Any algorithm period interrupted by an information request will be resumed after processing. To do this, a data memory subroutine 724 is reached through a transfer point 725 in FIG. 5. The involved algorithm period, $i_{MEM}$, is stored in a step 730, and the current values of o and d are stored as $o_{MEM}$ and $d_{MEM}$ in steps 731 and 732. Similarly, memory values of the o accumulators, $T_{MFC}$ (described hereinafter), internal flag and UAR flag are stored in steps 733–738. The routine then reverts to FIG. 1 through a return point 739.

Information requests and visits are not processed until learning is complete; a test 743 reverts to the wait state 610 in such a case.

Since an information request or a visit could occur at any time during an algorithm period, either of these may occur just after the completion of a prior algorithm period (arrow, FIG. 8B), or some greater time after the completion of a prior algorithm period (arrow, FIG. 8A). A test 744 determines if the operations counter, $O_{CTR}$, currently has a higher setting than half of the number of operations in the previous algorithm period, $o_i$. If it does (FIG. 8A), then the current algorithm period for that parameter is treated as a complete algorithm period, and processing will proceed through a transfer point 745 to the routines 656 and 676 (FIGS. 3 and 4) as described hereinbefore. In such a case, the data allocated to algorithm period i is processed in the routines 656 and 676 as in FIG. 8G. In the case of a visit, the data collected at that time, relating to algorithm period i+1, is processed in a next algorithm period, after the algorithm period, i, is incremented, as shown in FIG. 8E. After a visit, a new algorithm period is always started, without restoring any data. Therefore, once the processing in FIGS. 3 and 4 is completed in the subroutines 656 and 676 for period i, a plurality of steps 747–753 (identical to steps 708–714) are performed to advance to the next algorithm period, and then the subroutines 656,676 of FIGS. 3 and 4 are again reached through a transfer point 756 to perform the processing of FIG. 8H.

On the other hand, if the current algorithm period does not have more than half of the number of operations of the previous period (FIG. 8B), test 744 is negative (FIG. 1) and the number of operations of the two periods and the number of defects of the two periods are combined (FIG. 8C) in a pair of steps 757, 758 (FIG. 1). The accumulators are incremented by the o counter in steps 759–761 and the time since a maintenance flag occurred during a visit is incremented by the duration of the last algorithm period in step 762. And then the internal flag and update subroutines 656, 676 of FIGS. 3 and 4 are reached through a transfer point 764.

Figure 6:
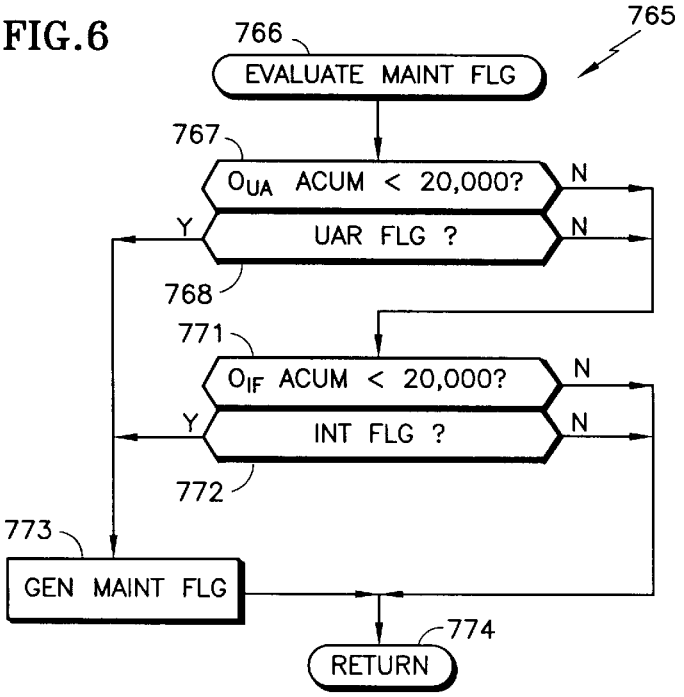
FIG. 6 evaluate maintenance flag.

An evaluate maintenance flag subroutine 765 is reached in FIG. 6 through a transfer point 766. In FIG. 6, a first test 767 determines if 20,000 operations have occurred since the last time that the average defect rate, R, was adjusted upwardly. If so, a maintenance flag will not be established based upon an upward adjustment of R. However, if 20,000 operations have not occurred, an affirmative result of test 767 reaches a test 768 to determine if the UAR flag was set in step 691 (FIG. 4) and not yet reset (by a downward adjustment of R) in step 701, FIG. 4. An affirmative result of test 768 therefore indicates that there has been an upward adjustment of the average defect rate (and thus, of the thresholds) since the last visit, not followed by a downward adjustment, within the last 20,000 operations. If either test 767 or test 768 is negative, then a test 771 determines if there have been 20,000 operations since an internal flag was set; the accumulator, $O_{IF}$ACUM, is reset upon the establishment of an internal flag at step 671 in FIG. 3. If 20,000 operations have not occurred, a test 772 determines if the internal flag is set. If it is, that means there has been no downward adjustment of the average defect rate (and thus, of the thresholds) since the internal flag was set, since it otherwise would have been reset at step 700 in FIG. 4. In FIG. 6, if there were an upward adjustment or an internal flag not followed by a downward adjustment, within 20,000 operations, an affirmative result of either test 768 or 772 will reach a step 773 to indicate that a maintenance flag should be generated, which may be used to cause generation of a corresponding maintenance message of the type described in the aforementioned copending applications. Then, FIG. 1 is reverted to through a return point 774.

If the processing through the evaluate maintenance flag subroutine 765 is as a result of a visit rather than an info request, a negative result of a test 777 will reach a step 780 to set a visited flag. This is used in FIG. 3 to prevent performing any algorithmic operations in the first algorithm period following the second pass of processing after a visit (FIG. 8H), so that only data collection occurs in the ensuing algorithm period. In FIG. 3, an affirmative result of test 658 reaches a step 778 that resets the visited flag and causes the remainder of FIG. 3 to be bypassed, so that processing of data collected during the algorithm period following period i in FIG. 8H (which has already been processed) will not be processed again as data is being collected within the next algorithmic period.

In FIG. 1, a step 781 increments i; a series of steps 782–784 reset the o and d counters and the algorithm timer for the next algorithm period. A plurality of steps 785–788 restore the time accumulated and the three operations accumulators to zero, since these all keep track of operations and time subsequent to a visit. Then, steps 789, 790 reset the internal and UAR flags, since the occurrence of the internal flag or the UAR flag is significant only when it is set after a visit. Then the routine reverts to the wait state 610 to await another operation, defect or new day.

On the other hand, if the processing through subroutine 765 was as a result of an information request (the info flag was set in step 722), the data combined just before the info request (FIG. 8C) must be restored for the algorithm periods i and i+1, as indicated in FIG. 8D. An affirmative result of test 777 reaches step 797 to reset the information request flag. Then, a data resume subroutine 801 is reached in FIG. 7 through a transfer point 802.

Figure 5:
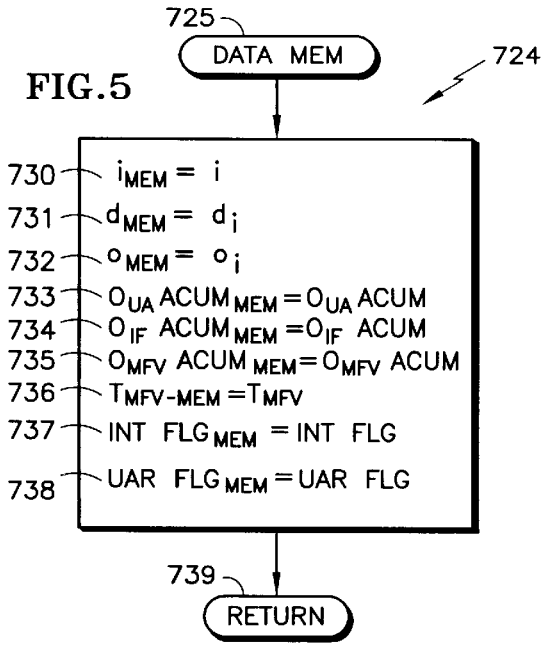
FIG. 5 data memory.
Figure 7:
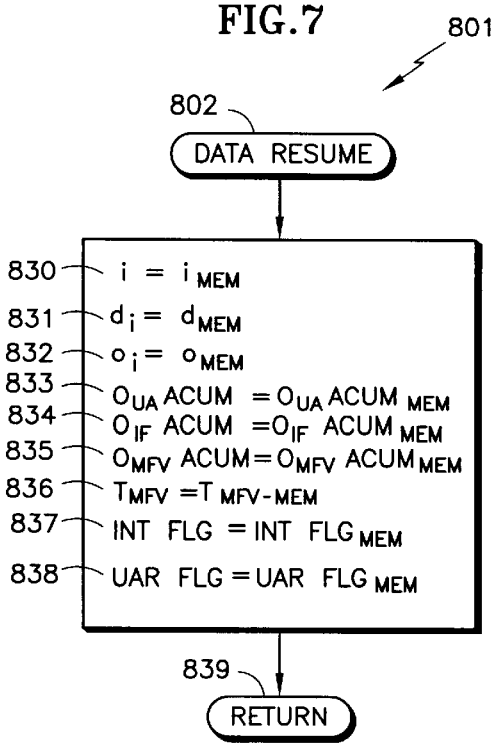
FIG. 7 data resume.

All of the settings of steps 730–738 in FIG. 5 are now reversed by respectively corresponding steps 830–838 in FIG. 7 so as to restore the last algorithm period (FIG. 8D). Then the program reverts to FIG. 1 through a return point 839, to await another operation defect or new day.

If desired in any implementation of the invention, the visit interrupt will not be recognized if the next previous visit of service personnel is within two weeks of the present time; this is because it is better to use older, complete data than to use only the relatively incomplete data that could be assembled in the two-week period (a single algorithm period of time). In such a case, a maintenance flag may be retained for two weeks, to be used in response to a visit within that time. Although not preferred, the maintenance flag may be generated, if desired in any embodiment, in response only to visits (and not information requests), or in response only to information requests (and not visits); or in response to one or more other particular events.

Figure 9:
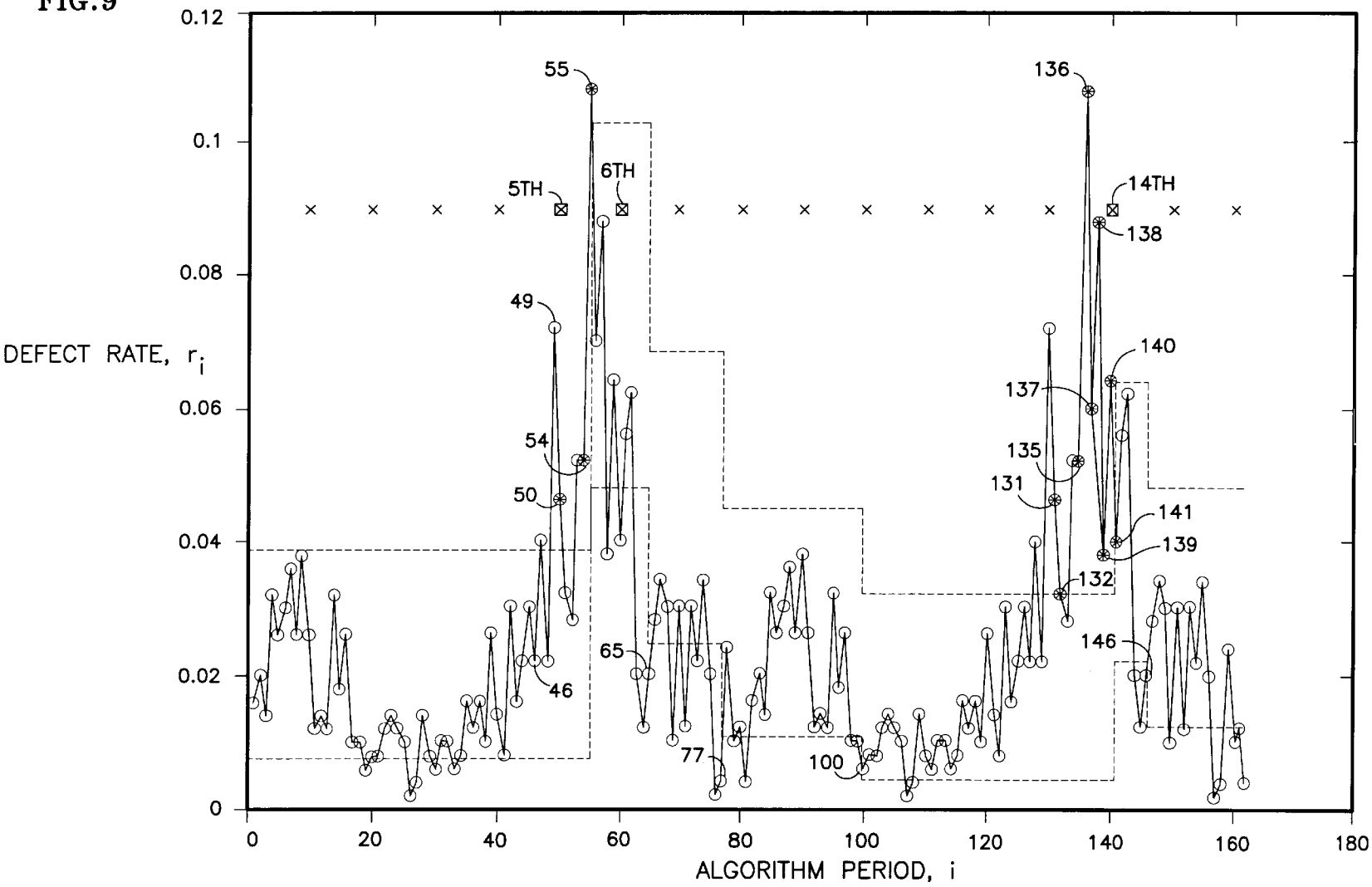
FIG. 9 is a plot of defects as a function of related operations.

In some parts of the world, landing doors, which block the access to the elevator hoistway from hallways, may be hinged to swing open and closed rather than sliding vertically or horizontally (swing doors). Many of these use hydraulic door closers, which occasionally lose oil pressure, causing the door to not close properly. This results in a high ratio of landing door rebounds per door operation (Parameter No. 6, FIG. 3, of said pair of applications). In FIG. 9 there is shown a simplified example of monitoring swing-door rebounds, illustrating how the thresholds are varied and the maintenance flags created. In FIG. 9, the circles (whether or empty or not) denote the defect rate, r, which in FIG. 9 varies between near zero and about 11%, and those circles having an asterisk therein denote defect rates which have resulted in generating an internal flag. In this example of FIG. 9, each algorithm period contains 500 door operations, with an initial average defect rate, R, of just over 2%. In FIG. 9, the X's denote mechanic visits, which are assumed to occur about every two months, which may translate to about every 5,000 operations. Each X which has a square around it indicates that a maintenance flag has been generated for the swing door rebound parameter. The upper and lower thresholds are the dotted lines beginning just below 4% and just below 1%, respectively.

In FIG. 9, the defect rate for all of the algorithm periods up to and including period 46 are below the upper threshold; note that the fact that there are defect rates below the lower threshold is relevant only when adjusting the thresholds by adjusting the average defect rate, R. In the $50^{th}$ algorithm period, an internal flag is generated because both the $49^{th}$ and $50^{th}$ (consecutive) algorithm periods are above the current threshold for each of the periods (which in this case are the same). The fifth visit by service personnel will generate a maintenance flag because of the internal flag generated in the $50^{th}$ algorithm period. The $54^{th}$ algorithm period will result in generation of an internal flag as will the $55^{th}$ algorithm period. In addition, since at the $55^{th}$ algorithm period there are three consecutive algorithm periods in a row which exceed the corresponding upper threshold, the average defect rate, R, is adjusted upwardly at that time, resulting in new upper and lower thresholds with a larger value of $\sigma$, as evidenced by the thresholds having a greater spread after the $55^{th}$ algorithm period than they have before the $55^{th}$ algorithm period. In the sixth mechanic visit, a maintenance flag will be generated as a consequence of the internal flag generated in the $55^{th}$ algorithm period. Note that performance improved somewhat after the fifth visit, around the $50^{th}$ through $54^{th}$ algorithm periods, but then deteriorated significantly thereafter. Thus, the mechanic did not fix the problem adequately during the fifth visit. On the other hand, following the sixth visit, the performance improves significantly, meaning that the service personnel did fix the problem.

At the $65^{th}$ algorithm period, the thresholds are adjusted downwardly because there are three algorithm periods in a row within which the defect rate is below the lower threshold. At the $77^{th}$ algorithm period, the thresholds are again adjusted downwardly. At the $100^{th}$ algorithm period, the thresholds are again adjusted downwardly. In algorithm period 131, an internal flag is generated because there are two consecutive defect rates above the upper threshold. In algorithm period 132, an internal flag is also generated; however, the threshold is not adjusted upwardly because there have been more than 20,000 operations of the door since the sixth visit, which is the last visit in which a maintenance flag was generated (step 773 and test 772). Internal flags continue to be generated through the $140^{th}$ algorithm period which coincides with the $14^{th}$ visit, thereby generating a maintenance flag. After the $14^{th}$ visit, there will be three algorithm periods in a row (139, 140, 141) in which the defect rate exceeds the corresponding threshold thereby causing the threshold to increase in algorithm period 141. Shortly thereafter, at algorithm period 146, there are three consecutive defect rates below the lower threshold so the threshold is adjusted downwardly once more. Although not illustrated, maintenance flags may of course be generated at other than visits or response to information requests.

In general, the present invention may be utilized with respect to those notable events and conditions in the prior pair of applications in which the generation of a maintenance message is dependent upon the ratio of the number of occurrences of the abnormality to the number of related operations, which in said aforementioned applications utilized fixed thresholds. In some of those, the thresholds are known by experts to require a certain fixed threshold, in which case the present invention would not be utilized.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of determining when one or more specific maintenance recommendation message, each relating to a specific corresponding parameter of an elevator, should be generated, said method comprising:

(a) monitoring conditions and/or events related to said parameter to determine any such conditions or events which are deemed notable with respect to elevator maintenance, and generating defect indications in response thereto;

(b) in each of a series of sequential algorithm periods (i) recording the number of said defect indications generated;

(ii) recording the number of operations of an elevator element related to said parameter;

(iii) providing a defect rate indication as a ratio of the number of said defect indications to the related number of said operations for an algorithm period;

(c) periodically generating an average defect rate indication from said number of defect indications and said number of operations recorded during a plurality of said periods including one or more periods prior to said each period;

(d) in said each algorithm period (iv) generating a deviation indication in response to said average defect rate indication and said related number of operations;

(v) generating an upper threshold indication in response to said average defect rate indication and said deviation indication; and (vi) selectively generating a maintenance flag indication, denoting that a maintenance recommendation message relating to said parameter should be generated, in response to at least one of (1) the number of said defect indications recorded in at least one of said periods exceeding the corresponding one of said upper threshold indications generated in said at least one period, and (2) said step (c) resulting in an upward adjustment of said average defect rate.

2. A method according to claim 1 wherein:

said periods are demarcated by at least one of (a) a predetermined number of defects recorded in said step (i), (b) a predetermined number of operations recorded in said step (ii), or (c) a predetermined period of time.

3. A method according to claim 1 wherein said step (v) comprises:

generating said maintenance flag indication in response to said number of defects exceeding said corresponding upper threshold indication in a selected plurality of said periods.

4. A method according to claim 3 wherein:

said selected plurality of periods are mutually contiguous.

5. A method according to claim 3 wherein said step (v) comprises:

generating said maintenance flag indication in response to said step (c) resulting in an upward adjustment of said average defect rate in a specific plurality of said periods.

6. A method according to claim 5 wherein:

there are more of said specific plurality of said periods than said selected plurality of periods.

7. A method according to claim 5 wherein:

said specific plurality of periods are mutually contiguous.

8. A method according to claim 1 wherein said step (c) comprises:

generating a new value of said average defect rate indication in any one of said periods in response to said number of said defect indications exceeding said corresponding upper threshold indication in a plurality of said periods.

9. A method according to claim 1 wherein said step (v) comprises:

generating said maintenance flag indication in response to said step (c) resulting in an upward adjustment of said average defect rate in a plurality of said periods.

10. A method according to claim 1 wherein said step (c) comprises:

periodically generating a new value of said average defect rate indication as (i) the existing average defect rate indication plus (ii) one-half of the difference between (1) a newly calculated arithmetical mean of said defect rate over a plurality of said periods and (2) the existing average defect rate indication.

11. A method according to claim 1 further comprising:

generating a lower threshold indication in response to said average defect rate indication and said deviation indication.

12. A method according to claim 11 wherein said step (c) comprises:

generating a new value of said average defect rate indication in any one of said periods in response to said corresponding number of said defect indications being less than said corresponding lower threshold indication in a plurality of said periods.

13. A method according to claim 11 wherein:

said average defect rate is adjusted downwardly.

14. A method according to claim 8 wherein said step (c) further comprises:

generating a new value of said average defect rate indication in any one of said periods in response to said number of said defect indications exceeding said corresponding upper threshold indication in a plurality of said periods.

15. A method according to claim 1 wherein said step (v) comprises:

selectively generating said maintenance flag indication following a particular event.

16. A method according to claim 15 wherein:

said maintenance flag is generated only following a particular event.

17. A method according to claim 15 wherein said particular event is at least one of one of (i) a visit to said elevator by maintenance personnel or (ii) a request that information about the condition of the elevator be provided.

18. A method according to claim 1 wherein:

said step (c) results in adjusting said average defect rate upwardly only if the total number of said operations, occurring since said maintenance flag was generated concurrently with said visit, is less than a related threshold number of operations.

19. A method according to claim 1 wherein:

said step (c) results in adjusting said average defect rate upwardly only if the total lapse of time, since said maintenance flag was generated concurrently with said visit, is less than a related threshold amount of time.

20. A method according to claim 1 wherein said step (v) comprises:

selectively generating said maintenance flag indication following a particular event in response to the number of said defect indications recorded in at least one of said periods exceeding said corresponding upper threshold indication, and said step (c) does not thereafter and prior to said particular event result in a downward adjustment of said average defect rate.

21. A method according to claim 1 wherein said step (v) comprises:

selectively generating said maintenance flag indication following a particular event in response to said step (c) resulting in an upward adjustment of said average defect rate and said step (c) does not thereafter and prior to said particular event result in a downward adjustment of said average defect rate.

22. A method according to claim 1 wherein:

said step (v) comprises:

selectively generating said maintenance flag indication following a particular event in response to the number of said defect indications recorded in one of said periods exceeding said corresponding upper threshold only if the total number of said operations, since the number of said defect indications recorded in one of said periods exceeded said corresponding threshold, is less than a related threshold number of operations.

23. A method according to claim 1 wherein:

said step (v) comprises:

selectively generating said maintenance flag indication following a particular event in response to said step (c) resulting in an upward adjustment of said average defect rate only if the total number of said operations, since said step (c) resulted in an upward adjustment of said average defect rate, is less than a related threshold number of operations.

* * * * *